US012304723B2

(12) United States Patent
Lange et al.

(10) Patent No.: US 12,304,723 B2
(45) Date of Patent: May 20, 2025

(54) CONTAINER HAVING BOX AND SLEEVE WITH ANTI-TAMPER MECHANISM

(71) Applicant: Philip Morris Products S.A., Neuchatel (CH)

(72) Inventors: Ross Lange, Neuchatel (CH); Julie Polier, Neuchatel (CH); Steven Shainwald, Lausanne (CH); Charles Johnson, Pully (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 18/257,341

(22) PCT Filed: Dec. 10, 2021

(86) PCT No.: PCT/EP2021/085319
§ 371 (c)(1),
(2) Date: Jun. 14, 2023

(87) PCT Pub. No.: WO2022/135982
PCT Pub. Date: Jun. 30, 2022

(65) Prior Publication Data

US 2024/0025630 A1 Jan. 25, 2024

(30) Foreign Application Priority Data

Dec. 21, 2020 (EP) ..... 20216196

(51) Int. Cl.
*B65D 85/10* (2006.01)
*B65D 5/38* (2006.01)
*B65D 5/54* (2006.01)

(52) U.S. Cl.
CPC ..... *B65D 85/1036* (2013.01); *B65D 5/38* (2013.01); *B65D 5/541* (2013.01)

(58) Field of Classification Search
CPC . B65D 5/38; B65D 5/54; B65D 5/541; B65D 85/10; B65D 85/1036
(Continued)

(56) References Cited

U.S. PATENT DOCUMENTS 1,884,030 A 10/1932 Maddox
2,776,081 A * 1/1957 Ringler ..... B65D 85/1036 206/268
(Continued)

FOREIGN PATENT DOCUMENTS

DE 25 38 845 A1 4/1976
GB 264689 A 1/1927
(Continued)

OTHER PUBLICATIONS

Russian Notice of Allowance and Search Report issued Apr. 8, 2025 in corresponding Russian Patent Application No. 2023119177, 12 pages.

*Primary Examiner* — Bryon P Gehman
(74) *Attorney, Agent, or Firm* — Oblon, McClelland, Maier & Neustadt, L.L.P.

(57) ABSTRACT

A container for consumer goods is provided, including: an outer sleeve including outer sleeve front and back walls, and first and second opposed outer sleeve side walls; an inner slide mounted within the outer sleeve and including inner slide bottom, front, and back walls; and a sleeve cover including sleeve cover first and second panels, the first panel detachably depending from the outer sleeve along a first line of weakness and extending between the outer sleeve back and front walls, the sleeve cover second panel detachably depending from the sleeve cover first panel along a second line of weakness and permanently affixed to an inner surface of the outer sleeve, such that upon separation of the sleeve cover first panel and the sleeve cover second panel: a first
(Continued)

outer sleeve opening is revealed, and the inner slide becomes movable between fully inserted and protruding positions.

15 Claims, 3 Drawing Sheets

(58) Field of Classification Search
USPC ..... 206/242, 264–273
See application file for complete search history.

(56) References Cited

U.S. PATENT DOCUMENTS

| | | | | | |
|---|---|---|---|---|---|
| RE28,882 | E | * | 6/1976 | Mueller | B65D 85/1054 206/273 |
| 3,987,955 | A | | 10/1976 | Saarinen | |
| 4,303,154 | A | * | 12/1981 | Hicks | B65D 85/109 206/242 |
| 9,663,266 | B2 | | 5/2017 | Schwester | |
| 2009/0088277 | A1 | | 4/2009 | Libonati | |
| 2013/0140201 | A1 | | 6/2013 | Ghini et al. | |
| 2016/0100630 | A1 | | 4/2016 | Clark et al. | |

FOREIGN PATENT DOCUMENTS

| | | | |
|---|---|---|---|
| RU | 2506214 | C2 | 2/2014 |
| WO | WO 2009/101071 | A1 | 8/2009 |
| WO | WO 2011/154822 | A1 | 12/2011 |

* cited by examiner

CONTAINER HAVING BOX AND SLEEVE WITH ANTI-TAMPER MECHANISM

The present invention relates to a novel container, which finds particular application as a container for consumer goods, such as elongate aerosol-generating articles and components of aerosol generating articles.

It is known to package consumer goods in containers formed from folded laminar blanks. By way of example, elongate smoking articles, such as cigarettes and cigars, are often sold in rigid box shaped containers, such as hinged lid containers having a box portion and a three-dimensional cup shaped hinge lid connected to the box about a hinge line extending across the back wall of the container. In use, the lid is pivoted about the hinge line to open the pack and so gain access to the consumer goods held in the box.

It is also known to package consumer goods in containers comprising an outer shell or sleeve and an inner slide or tray in which the consumer goods are housed and which is slidable within the outer shell. To remove consumer goods from such containers, a user slides the inner slide from an initial position within the outer shell to an open position in which the inner slide projects outwardly from the outer shell, in order to partially expose an open end or side of the inner slide. Such containers may be referred to as a slide-and-shell container.

It is generally desirable to improve the ease of use of reclosable containers. It is also desirable to be able to equip a reclosable container for consumer goods with tamper-evident means that allow a consumer to detect whether the content has been accessed before.

The present disclosure relates to a container for consumer goods. The container may comprise an outer sleeve comprising an outer sleeve front wall, an outer sleeve back wall, first and second opposed outer sleeve side walls. Further, the container may comprise an inner slide mounted within the outer sleeve, the inner slide comprising an inner slide bottom wall, an inner slide front wall, and an inner slide back wall. The container may also comprise a sleeve cover comprising a sleeve cover first panel and a sleeve cover second panel. The sleeve cover first panel may detachably depend from the outer sleeve along a first line of weakness and extend between the outer sleeve back wall and the outer sleeve front wall. The sleeve cover second panel may detachably depend from the sleeve cover first panel along a second line of weakness and be permanently affixed to an inner surface of the outer sleeve. Upon separation of the sleeve cover first panel from the outer sleeve and the sleeve cover second panel along the first and second lines of weakness, a first outer sleeve opening may be revealed at a top end of the outer sleeve. In addition, the inner slide may become movable within the outer sleeve between a fully inserted position, wherein the inner slide fully rests within the outer sleeve, and a protruding position wherein the inner slide extends at least partly outside of the outer sleeve through the first outer sleeve opening. A top edge of the inner slide front wall may be configured to engage with a corresponding bottom edge of the sleeve cover second panel to prevent the inner slide from being removed from the outer sleeve through the first outer sleeve opening.

According to the present invention, there is provided a container for consumer goods, the container comprising: an outer sleeve comprising an outer sleeve front wall, an outer sleeve back wall, first and second opposed outer sleeve side walls; an inner slide mounted within the outer sleeve, the inner slide comprising an inner slide bottom wall, an inner slide front wall, and an inner slide back wall, and a sleeve cover comprising a sleeve cover first panel and a sleeve cover second panel, the sleeve cover first panel detachably depending from the outer sleeve along a first line of weakness and extending between the outer sleeve back wall and the outer sleeve front wall, the sleeve cover second panel detachably depending from the sleeve cover first panel along a second line of weakness and permanently affixed to an inner surface of the outer sleeve, such that upon separation of the first panel from the outer sleeve and the second panel along the first and second lines of weakness: a first outer sleeve opening is revealed at a top end of the outer sleeve; and the inner slide becomes movable within the outer sleeve between a fully inserted position wherein the inner slide fully rests within the outer sleeve and a protruding position wherein the inner slide extends at least partly outside of the outer sleeve through the outer sleeve opening; wherein a top edge of the inner slide front wall is configured to engage with a corresponding bottom edge of the sleeve cover second panel to prevent the inner slide from being removed from the outer sleeve through the outer sleeve first opening.

As used herein, the terms the terms “front”, “back”, “upper”, “lower”, “top”, “bottom” and “side”, refer to the relative positions of portions of containers according to the invention and components thereof when the container is in an upright position. When describing containers according to the present invention, these terms are used irrespective of the orientation of the container being described. The front wall of the container is the wall of the outer sleeve to which the second panel of the anti-tamper cover is permanently affixed, such as by means of permanent adhesive.

The term “line of weakness” is used in the present specification to refer to a line on a sheet of material, such as paper or cardboard, along which the material has been weakened, such as through removal of some of the material along that line (for example by scoring) or by folding or creasing the sheet material along that line. This facilitates the tearing or breakage of the sheet material along a desired line.

In some embodiments, a line of weakness may also be provided as a line of perforations or slits or cuts. By way of example, the line of weakness may be provided as a separation line having slits or cuts arranged at predetermined intervals and separated by ties, such that separating portions of the container depending from one another along the separation lines, a relatively small number (for example 2 to 10) of ties needs to be broken.

As described briefly above, the present invention relates to a slide-and-sleeve container. The outer sleeve comprises an outer sleeve front wall, an outer sleeve back wall, first and second opposed outer sleeve side walls. The inner slide is mounted within the outer sleeve, and comprises an inner slide bottom wall, an inner slide front wall, and an inner slide back wall.

In contrast to existing slide-and-sleeve containers, a container in accordance with the present invention comprises a sleeve cover comprising a sleeve cover first panel and a sleeve cover second panel, wherein the sleeve cover first panel—which extends between the outer sleeve back wall and the outer sleeve front wall—depends detachably from the outer sleeve along a first line of weakness. In turn, the sleeve cover second panel depends detachably from the first panel along a second line of weakness, and the sleeve cover second panel is permanently affixed to an inner surface of the outer sleeve. When the sleeve cover first panel is separated from the outer sleeve and from the sleeve cover second panel along the first and second lines of weakness, respectively, a first outer sleeve opening is revealed at a top end of the outer sleeve. Further, as a consequence of the sleeve cover first panel becoming separated from the outer sleeve and from the sleeve cover second panel, the inner slide becomes movable within the outer sleeve between a fully inserted position, wherein the inner slide fully rests within the outer sleeve, and a protruding position wherein the inner slide extends at least partly outside of the outer sleeve through the outer sleeve opening. In addition, a top edge of the inner slide front wall is configured to engage with a corresponding bottom edge of the sleeve cover second panel to prevent the inner slide from being removed from the outer sleeve through the first outer sleeve opening.

Thus, in containers in accordance with the present invention the detachable first panel of the sleeve cover provides an anti-tamper feature. This is desirable, as it may promptly alert a consumer to the fact that consumer goods within the container may have been accessed before.

Additionally, the container of the invention may comprise a locking mechanism that advantageously helps control movement of the inner slide within the outer sleeve during use. This is desirable in that it enables easy and reliable access to the content of the inner sleeve. As will be described below, in some preferred embodiments, other components of the container may also be configured to cooperate in order to more thoroughly control and guide movement of the inner slide within the outer sleeve, such as to further enhance ease of use of the container.

In some embodiments, the outer sleeve further comprises one or more locking panels affixed to an inner surface of at least one of the outer sleeve front wall, the outer sleeve back wall and the outer sleeve side walls, wherein a top edge of the one or more locking panels is configured to engage with a corresponding edge of the inner slide bottom wall when the inner slide is in the fully inserted position to prevent the inner slide from being detached from the outer sleeve through a second outer sleeve opening at a bottom end of the outer sleeve. By providing a second locking mechanism at the bottom of the container, linear movement of the slide within the sleeve is advantageously limited at two ends. This further facilitates use of the container and desirably prevents the inner slide from being pushed too far and being removed from the outer sleeve.

In preferred embodiments, the inner slide further comprises a slide cover comprising a top panel depending from the inner slide back wall along a top edge of the inner slide back wall, the slide cover top panel being pivotable about the top edge of the inner slide back wall between a slide cover closed position and a slide cover open position to reveal a content of the inner slide.

The provision of an inner slide cover advantageously provides a further degree of protection for the consumer goods within the inner slide. In practice, when the container is opened for the first time, the consumer has not only to detach the first panel of the sleeve cover from the outer sleeve, but also to move the slide cover top panel from its closed position to its open position.

Further, this makes the container reclosable between uses. Once the first panel of the sleeve cover has been detached from the outer sleeve on first accessing the content of the inner slide, the consumer can advantageously rely on the slide cover top panel for ensuring that the remaining consumer goods are held within the inner slide between consecutive accesses.

More preferably, the slide cover top panel is configured to engage with the sleeve cover second panel when the inner slide is in the fully inserted slide position to secure the slide cover in the slide cover closed position. This is advantageous in that it ensures that between consecutive accesses the remaining consumer goods are held securely within the inner slide.

In particularly preferred embodiments, the slide cover top panel comprises a lock tab configured to engage with a cut out formed in the bottom edge of the sleeve cover second panel. This provides for a secure and reliable engagement between the slide cover panel and the bottom edge of the second panel. Thus, between consecutive accesses the remaining consumer goods are held within the inner slide in a particularly stable and secure manner.

In addition, cooperation between the lock tab of the slide cover top panel with the cut out in the bottom edge of the sleeve cover second panel produces a click-like sound. Advantageously, this may provide the user with an auditory cue confirming that closure of the container has been secured between uses.

In some embodiments, when the inner slide is in the fully inserted slide position and the slide cover panel engages with the second panel a recess is defined within the outer shell above the slide cover panel.

In some embodiments, the first panel of the sleeve cover detachably depends from the outer sleeve back wall along the first line of weakness, and the sleeve cover further comprises a line of weakness at least partially extending across the first panel between the outer sleeve back wall and the sleeve cover second panel to define a pull tab at one end of the first panel for facilitating separation of the sleeve cover first panel from the outer sleeve and from the sleeve cover second panel along the first and second separation lines, respectively. The provision of one such tab is advantageous as, upon opening the container for the first time, the pull tab principally acts as a handle. This may help the consumer to grip the sleeve cover first panel when the time comes for breaking the connection between the sleeve cover first panel and the outer sleeve and the sleeve cover second panel. In addition, as the pull tab is defined at one end of the sleeve cover first panel, the consumer is thus guided to apply the required tearing force along the most favourable direction, which may facilitate the opening operation and reduce the likelihood of breakages.

Preferably, the inner slide comprises a line of weakness extending across the inner slide back wall and dividing the inner slide back wall into a slide back wall bottom panel extending below the line of weakness and a slide back wall top panel extending above the line of weakness, wherein when the inner slide is in the protruding position the inner slide back wall top panel is configured to be pivotable along the line of weakness over a top edge of the outer sleeve back wall to facilitate access to a content of the inner sleeve. The provision of one such line of weakness has the advantage that, when the inner slide is moved into the protruding position, the slide back wall top panel can be pivoted backwards, which may make it easier for the consumer to extract the consumer goods from the top of the container.

This may be especially beneficial for those embodiments, which will be described in greater detail below, wherein an inner package containing the consumer goods is received within the inner slide and wherein the inner package comprises a tear tape extending 360 degrees around the inner package at a location towards a top of the inner package. By pivoting the inner slide back wall along the line of weakness over the top edge of the outer sleeve back wall, the user may have better and substantially unobstructed access to the portion of the tear tape extending across a back wall of the inner package, which may facilitate opening of the inner package.

As discussed briefly above, a container in accordance with the present invention finds use as a container for consumer goods, and may be used in particular for holding aerosol-generating articles, as will be described in more detail below. Preferably, the container comprises a group of consumer goods wrapped in an inner package, the inner package being received within and secured to the inner slide such that the inner package moves integral with the inner slide when the inner slide is moved between the fully inserted slide position and the protruding slide position. This is beneficial in that the consumer can easily and directly control the position of the inner package within the container by moving the slide between the fully inserted position and the protruding position.

For example, the inner package may be secured to a surface of the inner slide by providing permanent adhesive between the outer surface of the inner package and the surface of the inner slide. In some embodiments, a single dot of a permanent glue may be sufficient to this purpose.

Preferably, the inner package is sealed. This is beneficial for preserving the characteristics of the consumer goods within the container. Further, it combines with the provision of the sleeve cover to provide the consumer with a clear indication of whether the consumer goods within the container have been accessed before. As used herein, the term "sealed" is used to indicate that the inner package has been formed by wrapping a typically rectangular blank of air-impermeable packaging material about a group of consumer goods, and seals have been formed between overlapping edge portions of the blank. Preferably, a fin seal is formed on each longitudinal side of the inner package.

At the top of the inner package, an access opening is typically provided to enable access to and extraction of the consumer goods. In a "sealed" inner package, the opening only becomes accessible when the package is opened for the first time. For example, where an access opening is formed as a cut out in the blank from which the inner package is formed, the inner package further comprises a resealable label hermetically occluding the access opening. The provision of one such label has the advantage that the inner package can not only be reclosed, but also substantially resealed between subsequent accesses to the content of the inner package. Typically, one such label may include a tab by which the user can conveniently handle the label to move it between respective closed and open positions, as will also be described in greater detail below. As an alternative, in a "sealed package" an access opening may only be predefined, such as for example by the provision of lines of weakness in the inner package, yet the opening only effectively becomes accessible when the continuity of the material of the blank is interrupted along the lines of weakness when the user opens the inner package for the first time.

In some embodiments, the inner package comprises a tear tape for facilitating opening of the inner package and extraction of the consumer goods from the inner package. This ensures an easy and controlled first opening of the inner package and may help preserve a predefined portion of the inner package after the first opening of the container. The preserved remaining portion of the inner package advantageously protects the consumer goods.

In some embodiments, the inner package is resealable and comprises an access opening for extracting the consumer goods from the inner package, and a resealable adhesive label extending over the access opening and movable between a closed position, wherein the resealable adhesive label occludes the access opening, and an open position, wherein the resealable adhesive is at least partially lifted off a surface of the inner package to reveal the access opening.

This desirably makes the inner package resealable, such that the original characteristics of the consumer goods within the inner package may be preserved for a longer period of time.

In some embodiments, one or more lines of weakness (for example, cut lines) may be formed on the inner package to define the access opening. By way of example, lines of weakness extending over the front wall of the inner package or the top wall of the inner package or both may at least partly delimit a portion of the inner package that can move between respective closed and open positions. When the portion of inner package delimited by the lines of weakness is lifted, the access opening is revealed.

In certain preferred embodiments, a permanent connection is established between such portion of the inner package delimited by the lines of weakness and the resealable adhesive label. This may be achieved by providing permanent adhesive between an area of the inner surface of the resealable adhesive label and the underlying portion of the inner package delimited by the lines of weakness. Advantageously, movement of the resealable adhesive label between its closed and open positions causes the portion of the inner package to move integrally with the resealable adhesive label between its respective closed and open position. Thus, when the user lifts the resealable adhesive label into its open position, the underlying portion of the inner package delimited by the lines of weakness is also lifted and the access opening is revealed to enable extraction of the consumer goods.

In certain preferred embodiments, the inner slide further comprises a protective panel that depends from the top panel of the inner slide cover along a fold line defining a front edge of the inner slide cover top panel. The protective panel is pivotable about the fold line between a protective panel closed position and a protective panel open position. In the protective panel closed position, the protective panel is substantially parallel to the outer sleeve front wall. In practice, when an inner package is received within the inner slide, in the protective panel closed position the protective panel may come to rest against a front wall of the inner package. To move into the protective panel open position, the protective panel is tilted forwards and upwards to reveal an interior of the inner slide. In practice, when an inner package is received within the inner slide, to reach the protective panel open position the protective panel may be moved away from a front wall of the inner package to reveal the access opening in the inner package.

Thus, the protective panel contributes to the overall structural strength of the container and, in particular, of the inner slide. Further, the protective panel substantially hides and contributes to preventing access to the content of inner package between uses.

In those embodiments where a resealable adhesive label is provided that extends over the access opening, to access the consumer goods within the container a user needs to lift the inner slide containing the package to protrude out of the outer sleeve, move the protective panel into its open position and subsequently peel the resealable adhesive label from the label closed position to and the label open position. Thus, the protective panel provides an additional level of security. In some particularly preferred embodiments, the resealable adhesive label is permanently affixed to an inner surface of the protective panel, such that that movement of the protective panel between the protective panel closed position and the protective panel open position causes the resealable adhesive label to move between the label closed position and open position to reveal to access opening.

This is desirable in that the permanent connection established between the resealable adhesive label and the protective panel simplifies opening and closing of the inner package for the user, who can cause the resealable adhesive label to move between the label closed and open position by moving the protective panel between the protective panel closed and open position. In general, the protective panel may have a larger surface area and be made of a thicker and more rigid material, which may facilitate handling for the user.

Further, because movement of the resealable adhesive label is controlled indirectly via movement of the protective panel, and the protective panel is bound by its geometry and structure to move in a finely predetermined way, in these embodiments it is advantageously possible to achieve a particularly smooth and controlled peeling of the resealable adhesive label from the inner package. This is desirable in that it may help preserve the integrity and stability of the opening/closing mechanism. Further, as the user does not handle directly the resealable adhesive label, it may be easier to prevent the label from becoming accidentally stuck to itself or to other portions of the container during use.

In order to establish one such structural and functional connection between the protective panel and the resealable adhesive label, a permanent adhesive may for example be provided between an area on the outer surface of the resealable adhesive label and a corresponding area on the inner surface of the protective panel. Preferably, the inner package comprises an inner frame arranged within the inner package to hold the group of consumer goods in a defined collation pattern. The provision of one such inner frame increases the structural strength of the container and provides a further protection for the consumer goods within the inner package. Further, the provision of one such inner frame helps the inner package maintain its original shape even after a number of the consumer goods originally contained in the inner package have been extracted from the container. This has the benefit of facilitating smooth and reliable movement of the inner slide with the inner package between the fully inserted position and the protruding position.

In general, the size of the various components of a container in accordance with the invention will be a function of the size and number of the consumer goods destined to be held within the container.

A difference between a height of the outer sleeve and a height of the inner package may be at least 5 millimetres. In certain preferred embodiments, a difference between a height of the outer sleeve and a height of the inner package is at least 8 millimetres. More preferably, a difference between a height of the outer sleeve and a height of the inner package is at least 10 millimetres. Without wishing to be bound by theory, the inventors have observed that in containers wherein a difference between a height of the outer sleeve and a height of the inner package falls within such ranges, it may be easier to ensure that the inner slide and the outer sleeve cooperate as described above, such that the inner slide is efficiently prevented from sliding out of the outer sleeve in its entirety.

Preferably, a height of the inner slide front wall is less than or equal to 50 percent of a height of the inner package. More preferably, a height of the inner slide front wall is less than or equal to 45 percent of a height of the inner package. Even more preferably, a height of the inner slide front wall is less than or equal to 40 percent of a height of the inner package.

Preferably, a height of the inner slide front wall is at least 20 percent of a height of the inner package. More preferably, a height of the inner slide front wall is at least 25 percent of a height of the inner package. Even more preferably, a height of the inner slide front wall is at least 30 percent of a height of the inner package.

In some embodiments, a height of the inner slide front wall is from 20 percent of a height of the inner package to 50 percent of a height of the inner package, preferably from 25 percent of a height of the inner package to 50 percent of a height of the inner package, more preferably from 30 percent of a height of the inner package to 50 percent of a height of the inner package.

In other embodiments, a height of the inner slide front wall is from 20 percent of a height of the inner package to 45 percent of a height of the inner package, preferably from 25 percent of a height of the inner package to 45 percent of a height of the inner package, more preferably from 30 percent of a height of the inner package to 45 percent of a height of the inner package.

In further embodiments, a height of the inner slide front wall is from 20 percent of a height of the inner package to 40 percent of a height of the inner package, preferably from 25 percent of a height of the inner package to 40 percent of a height of the inner package, more preferably from 30 percent of a height of the inner package to 40 percent of a height of the inner package.

In some particularly preferred embodiments, a height of the inner slide front wall is from 30 percent of a height of the inner package to 35 percent of a height of the inner package, for example 33 percent of a height of the inner package.

Without wishing to be bound by theory, it is understood that the ratio between a height of the inner slide front wall and a height of the inner package substantially impacts an operative length over which the inner slide can move within the outer sleeve between the fully inserted position and the protruding position. By adjusting the ratio between a height of the inner slide front wall and a height of the inner package within the ranges described above, it is possible to ensure that in the protruding position access to the goods held within the inner package is especially facilitated for the consumer. At the same time, it is possible to ensure that the inner package is safely secured within the inner slide between successive openings of the container.

Preferably, a height of the inner slide front wall is less than 40 percent of a height of the sleeve. More preferably, a height of the inner slide front wall is less than 35 percent of a height of the sleeve. Even more preferably, a height of the inner slide front wall is less than 30 percent of a height of the sleeve.

Preferably, a height of the inner slide front wall is at least 15 percent of a height of the sleeve. More preferably, a height of the inner slide front wall is at least 20 percent of a height of the sleeve. Even more preferably, a height of the inner slide front wall is at least 25 percent of a height of the sleeve.

In some embodiments, a height of the inner slide front wall is from 15 percent of a height of the sleeve to 40 percent of a height of the sleeve, preferably from 20 percent of a height of the sleeve to 40 percent of a height of the sleeve, more preferably from 25 percent of a height of the sleeve to 35 percent of a height of the sleeve. In other embodiments, a height of the inner slide front wall is from 15 percent of a height of the sleeve to 35 percent of a height of the sleeve, preferably from 20 percent of a height of the sleeve to 40 percent of a height of the sleeve, more preferably from 25 percent of a height of the sleeve to 35 percent of a height of the sleeve. In further embodiments, a height of the inner slide front wall is from 15 percent of a height of the sleeve to 30 percent of a height of the sleeve, preferably from 20 percent of a height of the sleeve to 30 percent of a height of the sleeve, more preferably from 25 percent of a height of the sleeve to 30 percent of a height of the sleeve.

In embodiments wherein the outer sleeve comprises one or more locking panels affixed to an inner surface of at least one of the outer sleeve front wall, the outer sleeve back wall and the outer sleeve side walls, as described above, the one or more locking panels preferably comprise a front locking panel affixed to an inner surface of the outer sleeve front wall. Further, a height of the inner slide front wall is less than 55 percent of a distance between the bottom edge of the second panel and the top edge of the front locking panel. More preferably, a height of the inner slide front wall is less than 50 percent of a distance between the bottom edge of the second panel and the top edge of the front locking panel. Even more preferably, a height of the inner slide front wall is less than 45 percent of a distance between the bottom edge of the second panel and the top edge of the front locking panel.

Preferably, a height of the inner slide front wall is at least 25 percent of a distance between the bottom edge of the second panel and the top edge of the front locking panel. More preferably, a height of the inner slide front wall is at least 30 percent of a distance between the bottom edge of the second panel and the top edge of the front locking panel. Even more preferably, a height of the inner slide front wall is at least 35 percent of a distance between the bottom edge of the second panel and the top edge of the front locking panel.

In some embodiments, a height of the inner slide front wall is from 25 percent to 55 percent of a distance between the bottom edge of the second panel and the top edge of the front locking panel, more preferably from 30 percent to 55 percent of a distance between the bottom edge of the second panel and the top edge of the front locking panel, even more preferably from 35 percent to 55 percent of a distance between the bottom edge of the second panel and the top edge of the front locking panel. In other embodiments, a height of the inner slide front wall is from 25 percent to 50 percent of a distance between the bottom edge of the second panel and the top edge of the front locking panel, more preferably from 30 percent to 50 percent of a distance between the bottom edge of the second panel and the top edge of the front locking panel, even more preferably from 35 percent to 50 percent of a distance between the bottom edge of the second panel and the top edge of the front locking panel. In further embodiments, a height of the inner slide front wall is from 25 percent to 45 percent of a distance between the bottom edge of the second panel and the top edge of the front locking panel, more preferably from 30 percent to 45 percent of a distance between the bottom edge of the second panel and the top edge of the front locking panel, even more preferably from 35 percent to 45 percent of a distance between the bottom edge of the second panel and the top edge of the front locking panel.

In such embodiments wherein locking mechanisms are provided that delimit the operative length over which the inner slide moves between the fully inserted position and the protruding position, by adjusting the ratio between the height of the inner slide front wall and what is effectively the distance between such locking mechanisms it is possible to provide particularly stable and reliable opening and closing of the container.

Preferably, the inner slide further comprises first and second opposed inner slide side walls. This advantageously increases the structural strength of the inner slide and of the container as a whole. Further, it provides improved protection for the consumer goods within the inner sleeve and may further help stabilise them in a defined collation pattern.

Containers according to the invention are preferably formed from one or more folded laminar blanks. The one or more laminar blanks may be formed from any suitable material or combination of materials including, but not limited to, cardboard, paperboard, plastic, metal, or combinations thereof. The different components of the container may be formed from the same material, or from different materials. Each of the one or more laminar blanks may be laminar cardboard blank having a weight of between about 100 grams per square metre and about 350 grams per square metre. In preferred embodiments, the blank has a thickness of from about 100 micrometres to about 500 micrometres, preferably from about 200 micrometres to about 350 micrometres.

The container is preferably a rectangular parallelepiped comprising two wider walls (front and back) spaced apart by two narrower side walls. Containers according to the invention may be in the shape of a rectangular parallelepiped, with right-angled longitudinal and right-angled transverse edges. The container may comprise one or more rounded longitudinal edges, rounded transverse edges, bevelled longitudinal edges or bevelled transverse edges, or combinations thereof.

As noted above, the container may comprise a plurality of consumer goods received within the inner slide. The consumer goods may be aerosol-generating articles. The aerosol-generating articles may be filter cigarettes or other smoking articles in which an aerosol-generating substrate comprises a tobacco material that is combusted to form smoke. The aerosol-generating articles may be articles in which a tobacco material is heated to form an aerosol, rather than combusted. The aerosol-generating articles may be articles in which a nicotine-containing aerosol is generated from a tobacco material, tobacco extract, or other nicotine source, without combustion, and in some cases without heating, for example through a chemical reaction.

The aerosol-generating articles may be provided within the container in the form of a bundle wrapped in an inner package formed of metal foil or metallised paper. The inner package material may be formed as a laminate of a metallised polyethylene film, and a liner material. The liner material may be a super-calendered glassine paper. In addition, the inner package material may be provided with a print-receptive top coating. The inner package has an access opening through which aerosol-generating articles can be removed when the lid of the container is in a respective open position.

Through an appropriate choice of the dimensions, containers according to the invention may be designed to hold different total numbers of aerosol-generating articles, or different arrangements of aerosol-generating articles. For example, through an appropriate choice of the dimensions, containers according to the invention may be designed to hold a total of between ten and thirty aerosol-generating articles, such as smoking articles. The aerosol-generating articles may be arranged in different collations, depending on the total number.

The invention is defined in the claims. However, below there is provided a non-exhaustive list of non-limiting examples. Any one or more of the features of these examples may be combined with any one or more features of another example, embodiment, or aspect described herein.

Example 1. A container for consumer goods, the container comprising: an outer sleeve comprising an outer sleeve front wall, an outer sleeve back wall, first and second opposed outer sleeve side walls; and an inner slide mounted within the outer sleeve, the inner slide comprising an inner slide bottom wall, an inner slide front wall, and an inner slide back wall, a sleeve cover comprising a sleeve cover first panel and a sleeve cover second panel, the sleeve cover first panel detachably depending from the outer sleeve along a first line of weakness and extending between the outer sleeve back wall and the outer sleeve front wall, the sleeve cover second panel detachably depending from the sleeve cover first panel along a second line of weakness and permanently affixed to an inner surface of the outer sleeve, such that upon separation of the sleeve cover first panel from the outer sleeve and the sleeve cover second panel along the first and second lines of weakness: a first outer sleeve opening is revealed at a top end of the outer sleeve; and the inner slide becomes movable within the outer sleeve between a fully inserted position wherein the inner slide fully rests within the outer sleeve and a protruding position wherein the inner slide extends at least partly outside of the outer sleeve through the outer sleeve opening; wherein a top edge of the inner slide front wall is configured to engage with a corresponding bottom edge of the sleeve cover second panel to prevent the inner slide from being removed from the outer sleeve through the outer sleeve opening.

Example 2. A container according to example 1, wherein the outer sleeve further comprises one or more locking panels affixed to an inner surface of at least one of the outer sleeve front wall, the outer sleeve back wall and the outer sleeve side walls, wherein a top edge of the one or more locking panels is configured to engage with a corresponding edge of the inner slide bottom wall when the inner slide is in the fully inserted position to prevent the inner slide from being removed from the outer sleeve through a second outer sleeve opening at a bottom end of the outer sleeve.

Example 3. A container according to example 1 or 2, wherein the inner slide further comprises a slide cover comprising an inner slide cover top panel depending from the inner slide back wall along a top edge of the inner slide back wall, the inner slide cover top panel being pivotable about the top edge of the inner slide back wall between a slide cover closed position and a slide cover open position to reveal an inner slide opening.

Example 4. A container according to example 3, wherein the inner slide cover top panel is configured to engage with the sleeve cover second panel when the inner slide is in the fully inserted slide position to secure the slide cover in the slide cover closed position.

Example 5. A container according to example 4, wherein the slide cover panel comprises a lock tab configured to engage with a cut out formed in the bottom edge of the sleeve cover second panel.

Example 6. A container according to example 4 or 5, wherein when the inner slide is in the fully inserted slide position and the inner slide cover top panel engages with the second panel, a recess is defined within the outer shell above the inner slide cover top panel.

Example 7. A container according to any one of the preceding examples, wherein the first panel of the sleeve cover detachably depends from the outer sleeve back wall along the first line of weakness and the sleeve cover further comprises a line of weakness at least partially extending across the first panel between the outer sleeve back wall and the second panel to define a pull tab at one end of the first panel for facilitating separation of the of the first panel from the outer sleeve and the second panel along the first line of weakness and the second line of weakness.

Example 8. A container according to any one of the preceding examples, wherein the inner slide comprises a line of weakness extending across the inner slide back wall and dividing the inner slide back wall into a slide back wall bottom panel extending below the line of weakness and a slide back wall top panel extending above the line of weakness, wherein when the inner slide is in the protruding position the inner slide back wall top panel is configured to be pivotable along the line of weakness over a top edge of the outer sleeve back wall to facilitate access to a content of the inner sleeve.

Example 9. A container according to any one of the preceding examples, the container further comprising a group of consumer goods wrapped in an inner package, the inner package being received within and secured to the inner slide such that the inner package moves integral with the inner slide when the inner slide is moved between the fully inserted slide position and the protruding slide position.

Example 10. A container according to example 9, wherein the inner package is sealed.

Example 11. A container according to example 9 or 10, wherein the inner package comprises a tear tape for facilitating opening of the inner package and extraction of the consumer goods from the inner package.

Example 12. A container according to example 9, wherein the inner package is resealable and comprises an access opening for extracting the consumer goods from the inner package, and a resealable adhesive label extending over the access opening and movable between a closed position, wherein the resealable adhesive label occludes the access opening, and an open position, wherein the resealable adhesive label is at least partially lifted off a surface of the inner package to reveal the access opening.

Example 13. A container according to any one examples 3 to 12, wherein the inner slide cover further comprises a protective panel depending from the inner slide cover top panel along a fold line defining a front edge of the inner slide cover top panel, the protective panel being pivotable about the fold line between a protective panel closed position, wherein the protective panel is substantially parallel to the outer sleeve front wall, and a protective panel open position, wherein the protective panel is tilted forwards and upwards to reveal an interior of the inner slide.

Example 14. A container according to example 13 when depending on example 12, wherein the resealable adhesive label is permanently affixed to an inner surface of the protective panel, such that that movement of the protective panel between the protective panel closed position and the protective panel open position causes the resealable adhesive label to move between the respective closed position and open position to reveal to access opening.

Example 15. A container according to any one of examples 9 to 14, wherein the inner package comprises an inner frame arranged within the inner package to hold the group of consumer goods in a defined collation pattern.

Example 16. A container according to any one of examples 9 to 15, wherein a difference between a height of the outer sleeve and a height of the inner package is at least 10 millimetres.

Example 17. A container according to any one of the preceding examples, wherein the inner slide further comprises first and second opposed inner slide side walls.

In the following, the invention will be further described with reference to the drawings of the accompanying Figures, wherein.

Figure 7:
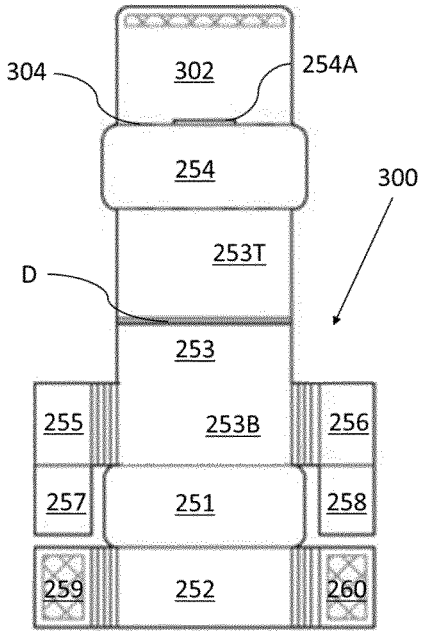
FIG. 7 shows a laminar blank for forming the inner slide of a second embodiment of a container in accordance with the present invention.
Figure 8:
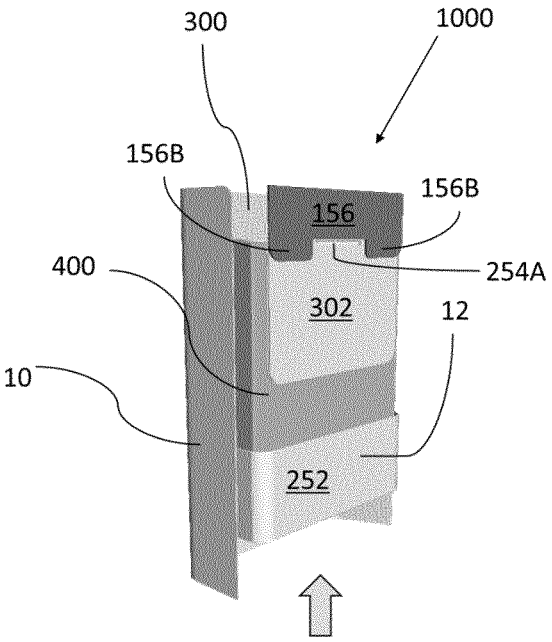
Figure 9:
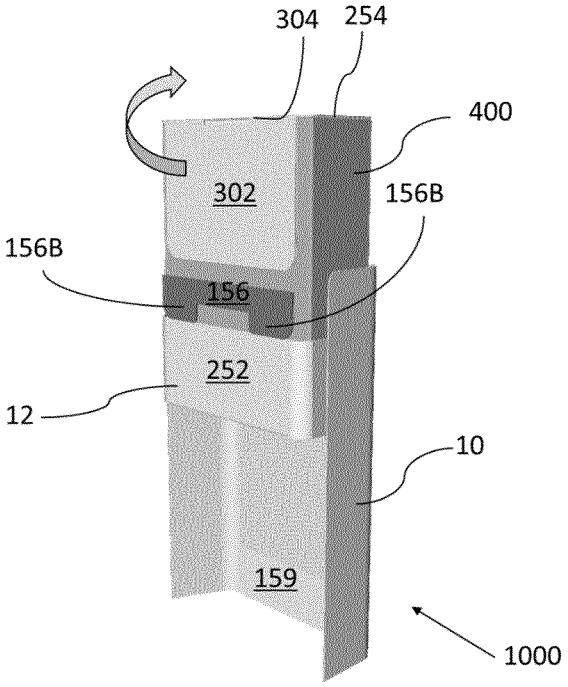
Figure 10:
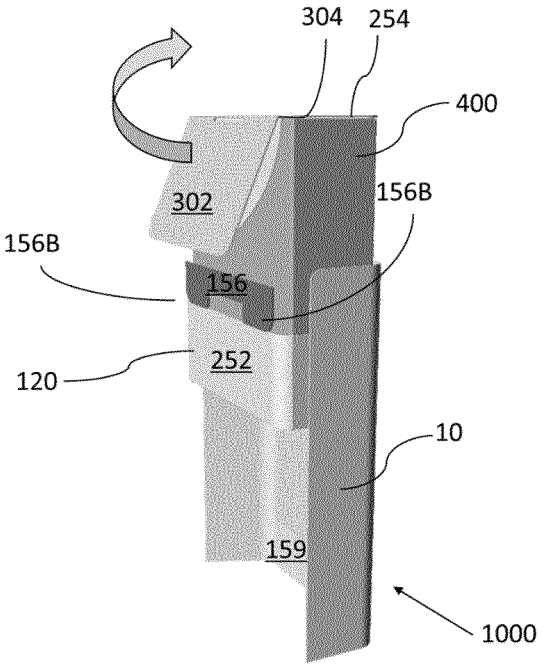
Figure 11:
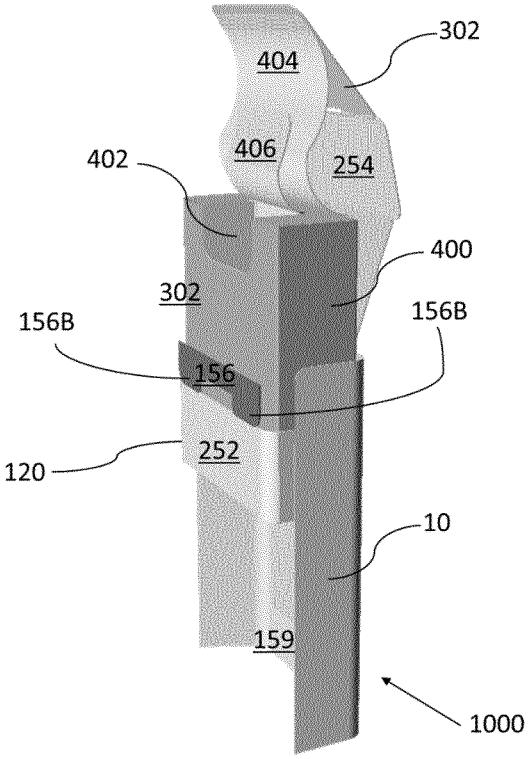

FIG. 8 shows a perspective view of a container in accordance with the second embodiment of FIG. 7 with a front wall of the outer sleeve removed, wherein the inner slide is in the fully inserted position; and FIGS. 9, 10, and 11 shows additional perspective views of the container of FIG. 7 with a front wall of the outer sleeve removed, wherein the inner slide is in the protruding position, at different times during pivoting of the protective panel of the inner sleeve between respective closed and open positions.

Figure 1:
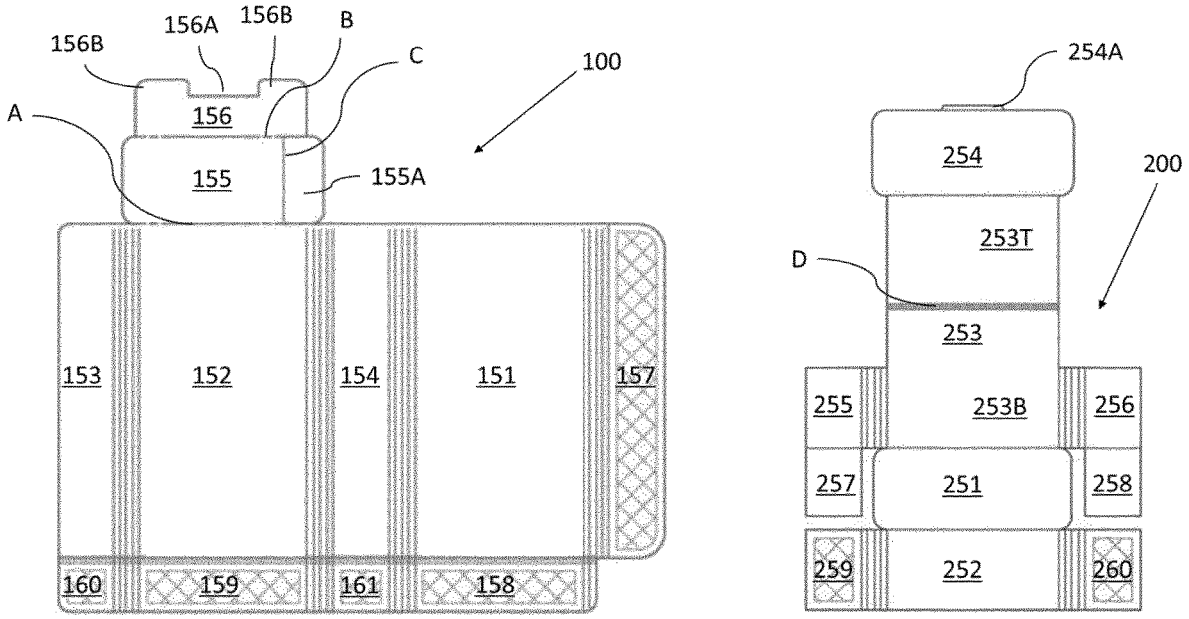
FIG. 1 shows two laminar blanks for forming a first embodiment of a container in accordance with the present invention.

FIG. 1 shows two laminar blanks for forming a container 1 according to the present invention, namely a first laminar blank 100 and a second laminar blank 200. The laminar blanks can be used to form a container 1 as shown in FIGS. 2 to 6.

The first laminar blank 100 is configured to form an outer sleeve 10 of the container 1.

The first laminar blank 100 comprises an outer sleeve front wall panel 151, an outer sleeve back wall panel 152, first and second outer sleeve side wall panels 153, 154.

Further, the first laminar blank 100 comprises a sleeve cover first panel 155 and a sleeve cover second panel 156. The sleeve cover first panel 155 depends along a line of weakness A from the outer sleeve back wall panel 152. The sleeve cover second panel 156 depends along a line of weakness B from the sleeve cover first panel 155. Thus, the sleeve cover first panel 155 is detachable from both the outer sleeve back wall panel 152 and the sleeve cover second panel 156.

The sleeve cover first panel 155 comprises a line of weakness C extending across the sleeve cover first panel 155 between the outer sleeve back wall panel 152 and the sleeve cover second panel 156 to define a pull tab 155A at one end of the sleeve cover first panel 155. Further, a cut out 156A is formed in the sleeve cover second panel 156 on the side opposite the sleeve cover first panel 155. Thus, two tabs 156B are defined in the sleeve cover second panel 156 on opposite sides of the cut out 156A.

The first laminar blank 100 also includes a panel 157 depending along a fold line from the outer sleeve front wall panel 151 for forming an outer sleeve side flap. When the outer sleeve 10 is formed by folding the first laminar blank 100, the outer sleeve side flap 157 is affixed by permanent adhesive (indicated by the cross hatching in the drawing of FIG. 1) to the first outer sleeve wall panel 153.

Further, the first laminar blank 100 also includes panels 158, 159, 160, 161 for forming outer sleeve locking panels. When the outer sleeve 10 is formed by folding the first laminar blank 100, the panels 158, 159, 160, 161 are folded by 180 degrees and affixed by permanent adhesive indicated by the cross hatching in the drawing of FIG. 1) to panels 151, 152, 153, 154, respectively.

The second laminar blank 200 is configured to form an inner slide 12 of the container 1.

The second laminar blank 200 comprises an inner slide bottom wall panel 251, an inner slide front wall panel 252, an inner slide back wall panel 253, and an inner slide cover panel 254.

The second laminar blank 200 further comprises inner slide side wall panels 255, 256, which depend along respective fold lines from the inner slide back wall panel 253, as well as dust flaps 257, 258, which depend along respective fold lines from the inner slide side wall panels 255, 256.

The inner slide back wall panel 253 comprises a line of weakness D extending across the inner slide back wall panel 253 and dividing the inner slide back wall panel into a slide back wall bottom panel 253B extending below the line of weakness D and a slide back wall top panel 253T extending above the line of weakness D.

The inner slide cover panel 254 comprises a lock tab 254A on the side opposite the inner slide back wall panel 253.

In addition, the second laminar blank 200 comprises side panels 259, 260 depending along respective fold lines from the inner slide front wall panel 252 for forming inner slide side flaps. When the inner slide 12 is formed by folding the second laminar blank 200, the inner slide side flaps 259, 260 are affixed by permanent adhesive (indicated by the cross hatching in the drawing of FIG. 1) to the inner slide side wall panels 255, 256.

In order to assemble a container 1 in accordance with the present invention, a group of consumer goods—for example, a bundle of aerosol-generating article arranged in accordance with a predetermined collation—is partially circumscribed by a reinforcing inner frame and wrapped within a flexible liner to form an inner package. For example, the inner liner may be sealed by means of seals formed as fin seals. A tear tape is applied on the inside of the flexible liner for ease of opening.

The laminar blank 200 for forming the inner slide is wrapped and folded around the thus formed package. The laminar blank 100 for forming the outer sleeve is wrapped and folded around the inner slide containing the package. As the second panel 156 of the outer sleeve cover is affixed to the outer sleeve front wall panel 151, access to the consumer goods at the top of the container 1 is thus not enabled until the first opening of the container, as will be described below.

As mentioned briefly above, a container 1 formed from the laminar blanks 100 and 200 of FIG. 1 is shown in FIGS. 2 to 6. In more detail, detachment of the first panel of the outer sleeve cover from the remainder of the outer sleeve upon first opening the container 1 is shown in, and will be described below with reference to FIGS. 2, 3, and 4. Further, relative movement and cooperation of the inner slide 12 within the outer sleeve 10 following detachment of the first panel of the outer sleeve cover from the remainder of the outer sleeve will be described below with reference to FIGS. 5 and 6.

Figure 2:
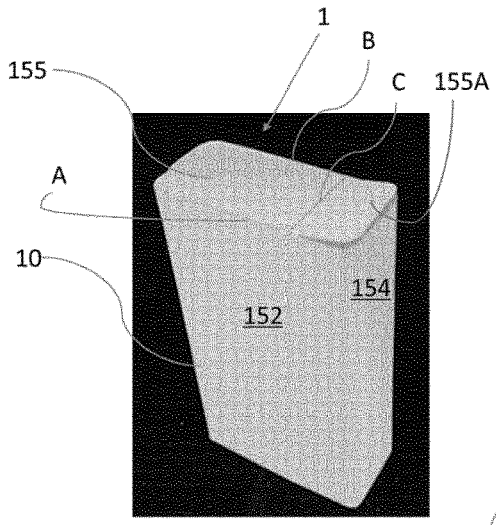
FIGS. 2, 3 and 4 show perspective views of a container in accordance with the present invention at different times during detachment of the first panel of the outer sleeve cover from the remainder of the outer sleeve.
Figure 3:
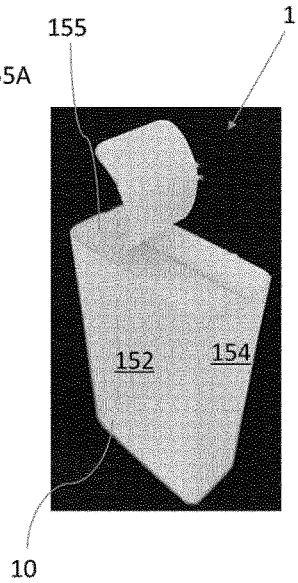
Figure 4:
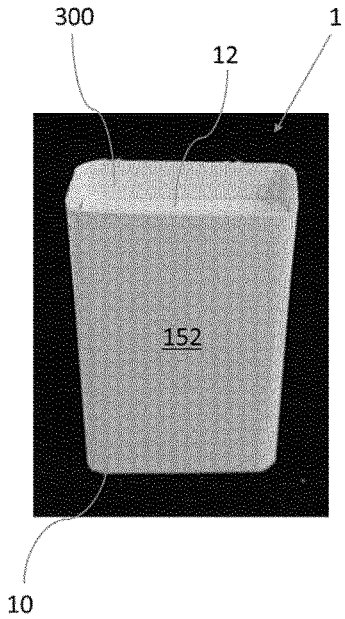

FIG. 2 to 4 depict a container 1 in accordance with the present invention at successive moments in time when it is opened for the first time. To this purpose, the consumer can detach the first panel 155 of the outer sleeve cover from the remainder of the outer sleeve 10. In more detail, the first panel 155 is detached from the outer sleeve back wall 152 along the line of weakness A, and from the second panel 156 of the outer sleeve cover along the line of weakness B. This operation is facilitated by the provision of the end pull tab 155A, by which the consumer can pull the first panel 155 off the remainder of the outer sleeve. Detachment of the first panel 155 of the outer sleeve cover from the remainder of the outer sleeve 10 reveals a first opening 300 at the top end of the outer sleeve 10. As this is an essential step for gaining access to the content of the inner sleeve, the first panel 155 of the outer sleeve cover acts effectively acts as an anti-tamper feature.

Figure 5:
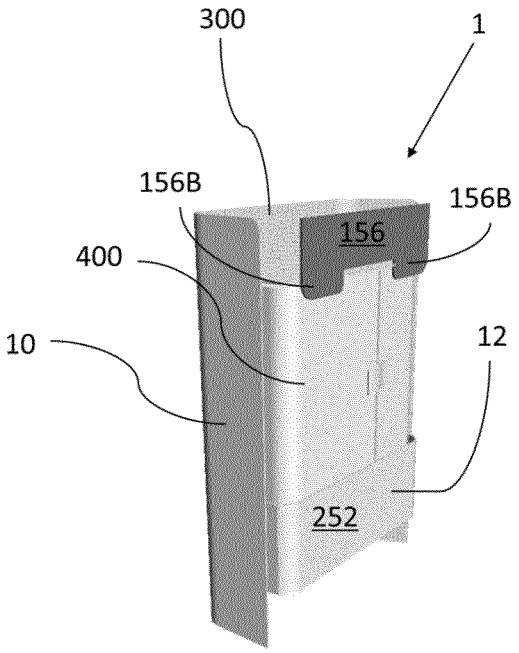
FIG. 5 shows a perspective view of a container in accordance the first embodiment of FIG. 1 with a front wall of the outer sleeve removed, wherein the inner slide is in the fully inserted position.
Figure 6:
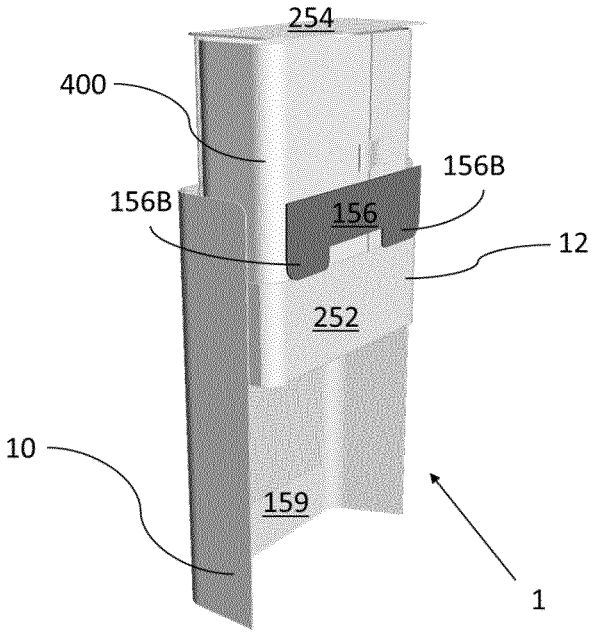
FIG. 6 shows another perspective view of the container of FIG. 5 with a front wall of the outer sleeve removed, wherein the inner slide is in the protruding position.

FIGS. 5 and 6 show an outer sleeve 10 an inner slide 12 formed from the laminar blanks of FIG. 1. For the sake of convenience, the front wall of the outer sleeve 10 has been removed to show how the inner slide 12 moves within the outer sleeve 10 between a fully inserted position (FIG. 5) and a protruding position (FIG. 6) and how certain components of the inner slide 12 and the outer sleeve 10 cooperate in each position.

As shown in FIGS. 5 and 6, the inner slide 12 is mounted within the outer sleeve 10. An inner package 400 is received within the inner slide 12.

As a result of the detachment of the first panel of the outer sleeve cover, a first outer sleeve opening 300 has been revealed at a top end of the outer sleeve 10. The inner slide 12 is thus movable within the outer sleeve 10 between a fully inserted position (FIG. 5) wherein the inner slide 12 fully rests within the outer sleeve 10 and a protruding position (FIG. 6) wherein the inner slide 12 extends partly outside of the outer sleeve 10 through the first outer sleeve opening 300.

As illustrated in FIG. 5, in the fully inserted position, top edges of the outer sleeve locking panels 158, 159, 160, 161 are configured to engage with corresponding bottom edges of the inner slide 12. Thus, the inner slide 12 is prevented from being removed from the outer sleeve 10 through a second outer sleeve opening at the bottom end of the outer sleeve 10. In more detail, in the embodiment shown, the edges of the bottom wall 251 of the inner slide 12 cooperate with the top edges of the outer sleeve locking panels 158, 159, 160, 161.

Further, in the fully inserted position, the inner slide cover panel 254 is configured to engage with the second panel 156 of the outer sleeve 10. This advantageously secures the inner slide cover panel 254 in the slide cover closed position. In the embodiment shown in FIG. 5, the lock tab 254A of the slide cover panel engages with the cut out 156A formed in the bottom edge of the second panel 156 of the outer sleeve 10.

As visible in FIG. 5, when the inner slide 10 is in the fully inserted slide position and the slide cover panel 254 engages with the second panel 156, a recess is defined within the outer shell 12 above the slide cover panel 254.

As shown in FIG. 6, in the protruding position a top edge of the inner slide front wall 252 is configured to engage with a corresponding bottom edge of the second panel 156 of the outer sleeve cover to prevent the inner slide 12 from being removed from the outer sleeve 10 through the first outer sleeve opening 10. In particular, in the embodiment shown, bottom edges of the side tabs 156B cooperate with the top edge of the inner slide front wall 252.

When the inner slide 12 is in the protruding position, the inner slide cover panel 254 may be pivoted to reveal the content of the inner slide. Therefore, the consumer goods within the inner slide are accessible. For increased ease of use, the slide back wall top panel 253T can be further pivoted about the line of weakness D, such that a back of a top portion of the consumer goods within the slide becomes exposed. This facilitates extraction of the consumer goods.

FIG. 7 shows a variant 300 of the second laminar blank for forming the inner slide of a container according to the present invention. The laminar blank 300 can be used with the first laminar blank 100 of FIG. 1 to form a second embodiment of a container 1000 as shown in FIGS. 2 to 6.

The second laminar blank 300 is configured to form an inner slide 120 of the container 1000.

The second laminar blank 300 is a modified version of the second laminar blank 200 of FIG. 1 and will be described below only insofar as it differs from the second laminar blank 200 of FIG. 1. In the drawing of FIG. 7, the same reference numerals have been used to identify elements of the second laminar blank 300 that have been used in the drawing of FIG. 1 to identify corresponding elements of the second laminar blank 200.

The second laminar blank 300 of FIG. 7 differs from the second laminar blank 200 of FIG. 1 in that it further comprises an inner slide protective panel 302, which depends along a respective fold line 304 from the inner slide cover panel 254 on the same side of lock tab 254A. In effect, the lock tab 254A is formed by way of a cut line extending through the inner slide protective panel 302. Thus, when—as will be described in more detail below—the inner slide protective panel 302 is pivoted between respective closed and open positions about the fold line 304, the lock tab 254A does not move along with the inner slide protective panel 302.

As will become apparent from the following description of the drawings of FIGS. 8, 9, 10 and 11, the second laminar blank 300 is especially suited to being used in combination with a resealable inner package 400 that comprises an access opening 402 and a reclosable adhesive label 404 covering the access opening 402 and extending beyond a periphery of the access opening 402, wherein the reclosable adhesive label is at least partly releasably affixed to the inner package 400 by a resealable adhesive provided on a first area of the inner surface of the reclosable adhesive label 404 extending about at least the periphery of the access opening 402 of the inner package 400. The reclosable adhesive label 404 is thus movable between a closed position, wherein the reclosable adhesive label 404 extends over and occludes the access opening 402 and an open position, wherein the reclosable adhesive label 404 is partly lifted off the outer surface of the inner package 400 to reveal the access opening, thus enabling access to the consumer goods within the inner package.

In the embodiment shown in the drawings of FIGS. 8, 9, 10 and 11, the access opening 402 is defined by one or more lines of weakness—such as, for example, a cut line—in the inner package 400 that define a portion 406 of the inner package 400 that is also movable between respective closed and open positions. In one such embodiment, the reclosable adhesive label 404 is affixed to the portion 406 of the inner package 400 by a permanent adhesive provided on a second area of the inner surface of the reclosable adhesive label 404 extending within the periphery of the portion 406, such that the portion 406 moves integrally with the reclosable adhesive label 404 to reveal or occlude the access opening 402.

When a container 1000 is assembled and an inner package 400 containing a group of consumer goods is received within an inner slide 120, the protective panel 302 comes to rest against a front wall of the inner package 400. This provides increased protection for the consumer goods within the inner package and enhanced structural strength and rigidity of the container, which may facilitate storage and transportation thereof. Further, as will become apparent from the remainder of the description of this second embodiment, the protective panel provides an added layer of protection over the opening/closing mechanism of the inner package 400 and of the container 1000 as a whole.

FIGS. 8 and 9 show an outer sleeve 10 and an inner slide 120 formed from the first laminar blank of FIG. 1 and the second laminar blank of FIG. 7. For the sake of convenience, the front wall of the outer sleeve 10 has been removed to show how the inner slide 120 moves within the outer sleeve 10 between a fully inserted position (FIG. 8) and a protruding position (FIG. 9) and how certain components of the inner slide 120 and the outer sleeve 10 cooperate in each position.

As shown in FIGS. 8 and 9, the inner slide 120 is mounted within the outer sleeve 10. An inner package 400 is received within the inner slide 120. As a result of the detachment of the first panel of the outer sleeve cover, a first outer sleeve opening 300 has been revealed at a top end of the outer sleeve 10. The inner slide 120 is thus movable within the outer sleeve 10 between a fully inserted position (FIG. 8) wherein the inner slide 120 fully rests within the outer sleeve 10 and a protruding position (FIG. 9) wherein the inner slide 120 extends partly outside of the outer sleeve 10 through the first outer sleeve opening 300.

As illustrated in FIG. 8, in the fully inserted position, top edges of the outer sleeve locking panels 158, 159, 160, 161 are configured to engage with corresponding bottom edges of the inner slide 120. Thus, the inner slide 120 is prevented from being removed from the outer sleeve 10 through a second outer sleeve opening at the bottom end of the outer sleeve 10. In more detail, in the embodiment shown, the edges of the bottom wall 251 of the inner slide 120 cooperate with the top edges of the outer sleeve locking panels 158, 159, 160, 161.

Further, in the fully inserted position shown in FIG. 8, the inner slide cover panel 254 is configured to engage with the second panel 156 of the outer sleeve 10. This advantageously secures the inner slide cover panel 254 in the slide cover closed position. As shown in FIG. 8, the lock tab 254A of the slide cover panel engages with the cut out 156A formed in the bottom edge of the second panel 156 of the outer sleeve 10.

As shown in FIG. 9, in the protruding position a top edge of the inner slide front wall 252 is configured to engage with a corresponding bottom edge of the second panel 156 of the outer sleeve cover to prevent the inner slide 120 from being removed from the outer sleeve 10 through the first outer sleeve opening. In particular, as shown in FIG. 9, bottom edges of the side tabs 156B cooperate with the top edge of the inner slide front wall 252.

When the inner slide 120 is in the protruding position, the protective panel 302 may be pivoted about fold line 304 and lifted off the front of the inner package 400. As shown in FIGS. 10 and 11, as the protective panel 302 depends from the inner slide cover panel 254, when lifting the protective panel 302 off the front of the inner package 400, the inner slide cover panel 254 will also, in turn, be pivoted to reveal the content of the inner slide. Like in the first embodiment of FIGS. 5 and 6, for increased ease of use, the slide back wall top panel 253T can be further pivoted about the line of weakness D to further facilitate extraction of the consumer goods.

As shown in the drawings of FIGS. 8, 9, 10 and 11, in this particular embodiment the reclosable adhesive label 404 is permanently affixed to an inner surface of the protective panel 302 by a permanent adhesive provided on a first area of an outer surface of the reclosable adhesive label 404. Thus, as illustrated in the drawings of FIGS. 10 and 11, when the protective panel 302 is pivoted about fold line 304, movement of the protective panel 302—indicated schematically by the curved arrow—also automatically lifts the reclosable adhesive label 404 and the portion 406 of the inner package 400 to reveal the access opening 402 and enable extraction of the consumer goods from the inner package 400.

Thus, a container 1000 in accordance with the second embodiment illustrated by reference to the drawings of FIGS. 7 to 11 provides the user with a particularly smooth opening and closing mechanism, whereby access to the consumer goods in the inner package 400 can be gained by combining the linear movement of the inner slide 120 within the outer sleeve 10 with the gradual peeling of the reclosable adhesive label 404 off the inner package 400 obtained indirectly by lifting of the protective panel 302. This is advantageous in that the user can conveniently manipulate a larger and typically thicker element of the container—the protective panel 302—instead of directly pulling on the reclosable adhesive label. This may help prevent wear and tear of the reclosable adhesive label.

At the same time, the provision of one such reclosable adhesive label, renders the inner package 400 substantially resealable. This is especially beneficial when the inner package 400 is manufactured by forming fin seals along the side of the inner package as this enables a particularly accurate seal of the inner package 400, such that the properties of the consumer goods are especially well preserved during storage and transportation.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±10% of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. A container for consumer goods, the container comprising:

an outer sleeve comprising an outer sleeve front wall, an outer sleeve back wall, and first and second opposed outer sleeve side walls;

an inner slide mounted within the outer sleeve, the inner slide comprising an inner slide bottom wall, an inner slide front wall, and an inner slide back wall; and a sleeve cover comprising a sleeve cover first panel and a sleeve cover second panel, the sleeve cover first panel detachably depending from the outer sleeve along a first line of weakness and extending between the outer sleeve back wall and the outer sleeve front wall, the sleeve cover second panel detachably depending from the sleeve cover first panel along a second line of weakness and permanently affixed to an inner surface of the outer sleeve, such that upon separation of the sleeve cover first panel from the outer sleeve and the sleeve cover second panel along the first and second lines of weakness:

a first outer sleeve opening is revealed at a top end of the outer sleeve, and the inner slide becomes movable within the outer sleeve between a fully inserted position, in which the inner slide fully rests within the outer sleeve, and a protruding position, in which the inner slide extends at least partly outside of the outer sleeve through the outer sleeve opening, wherein a top edge of the inner slide front wall is configured to engage with a corresponding bottom edge of the sleeve cover second panel to prevent the inner slide from being removed from the outer sleeve through the first outer sleeve opening.

2. The container according to claim 1, wherein the outer sleeve further comprises one or more locking panels affixed to an inner surface of at least one of the outer sleeve front wall, the outer sleeve back wall and the outer sleeve side walls, and wherein a top edge of the one or more locking panels is configured to engage with a corresponding edge of the inner slide bottom wall when the inner slide is in the fully inserted position to prevent the inner slide from being removed from the outer sleeve through a second outer sleeve opening at a bottom end of the outer sleeve.

3. The container according to claim 1, wherein the inner slide further comprises a slide cover comprising an inner slide cover top panel depending from the inner slide back wall along a top edge of the inner slide back wall, the inner slide cover top panel being pivotable about the top edge of the inner slide back wall between a slide cover closed position and a slide cover open position to reveal an inner slide opening.

4. The container according to claim 3, wherein the inner slide cover top panel is configured to engage with the sleeve cover second panel when the inner slide is in the fully inserted slide position to secure the slide cover in the slide cover closed position.

5. The container according to claim 4, wherein the slide cover top panel comprises a lock tab configured to engage with a cut-out formed in the bottom edge of the sleeve cover second panel.

6. The container according to claim 4, wherein, when the inner slide is in the fully inserted slide position and the inner slide cover top panel engages with the sleeve cover second panel, a recess is defined within the outer shell above the inner slide cover top panel.

7. The container according to claim 3, wherein the slide cover of the inner slide further comprises a protective panel depending from the inner slide cover top panel along a fold line defining a front edge of the inner slide cover top panel, the protective panel being pivotable about the fold line between a protective panel closed position, in which the protective panel is substantially parallel to the outer sleeve front wall, and a protective panel open position, in which the protective panel is tilted forwards and upwards to reveal an interior of the inner slide.

8. The container according to claim 7, further comprising a group of consumer goods wrapped in an inner package, the inner package being received within and secured to the inner slide such that the inner package moves integral with the inner slide when the inner slide is moved between the fully inserted slide position and the protruding slide position, wherein the inner package is resealable and comprises an access opening configured for extracting the consumer goods from the inner package, and a resealable adhesive label extending over the access opening and movable between a closed position, in which the resealable adhesive label occludes the access opening, and an open position, in which the resealable adhesive label is at least partially lifted off a surface of the inner package to reveal the access opening, and wherein the resealable adhesive label is permanently affixed to an inner surface of the protective panel, such that movement of the protective panel between the protective panel closed position and the protective panel open position causes the resealable adhesive label to move between the respective closed position and open position to reveal the access opening.

9. The container according to claim 1, wherein the first panel of the sleeve cover detachably depends from the outer sleeve back wall along the first line of weakness and the sleeve cover further comprises a line of weakness at least partially extending across the first panel between the outer sleeve back wall and the second panel to define a pull tab at one end of the first panel for facilitating separation of the first panel from the outer sleeve and the second panel along the first line of weakness and the second line of weakness.

10. The container according to claim 1, wherein the inner slide further comprises a line of weakness extending across the inner slide back wall and dividing the inner slide back wall into a slide back wall bottom panel extending below the line of weakness and a slide back wall top panel extending above the line of weakness, and wherein when the inner slide is in the protruding position the inner slide back wall top panel is configured to be pivotable along the line of weakness over a top edge of the outer sleeve back wall to facilitate access to a content of the inner sleeve.

11. The container according to claim 1, further comprising a group of consumer goods wrapped in an inner package, the inner package being received within and secured to the inner slide such that the inner package moves integral with the inner slide when the inner slide is moved between the fully inserted slide position and the protruding slide position.

12. The container according to claim 11, wherein the inner package comprises a tear tape configured to facilitate opening of the inner package and extraction of the consumer goods from the inner package.

13. The container according to claim 11, wherein the inner package is resealable and comprises an access opening configured for extracting the consumer goods from the inner package, and a resealable adhesive label extending over the access opening and movable between a closed position, in which the resealable adhesive label occludes the access opening, and an open position, in which the resealable adhesive label is at least partially lifted off a surface of the inner package to reveal the access opening.

14. The container according to claim 11, wherein the inner package comprises an inner frame arranged within the inner package configured to hold the group of consumer articles in a defined collation pattern.

15. The container according to claim 1, wherein the inner slide further comprises first and second opposed inner slide side walls.

* * * * *